US006449373B2

(12) United States Patent
Baker

(10) Patent No.: US 6,449,373 B2
(45) Date of Patent: Sep. 10, 2002

(54) PROTECTION AND SOLVENT WASHING OF IN-CANAL HEARING AIDS

(76) Inventor: Lawrence K Baker, 119 Cyprus St., Gote City, VA (US) 24251

( * ) Notice: Subject to any disclaimer, the term of this patent is extended or adjusted under 35 U.S.C. 154(b) by 0 days.

(21) Appl. No.: 09/864,416

(22) Filed: May 25, 2001

Related U.S. Application Data

(60) Provisional application No. 60/210,640, filed on Jun. 9, 2000.

(51) Int. Cl.[7] ..... H04R 25/00
(52) U.S. Cl. ..... 381/325; 381/325
(58) Field of Search ..... 381/325, 322, 381/328, 380, 324, 312, FOR 127, FOR 133, FOR 135; 181/129, 135

(56) References Cited

U.S. PATENT DOCUMENTS 3,842,829 A * 10/1974 Ellis ..... 128/868
4,937,876 A * 6/1990 Biermans ..... 181/130
4,972,488 A * 11/1990 Weiss et al. ..... 381/322
4,987,597 A * 1/1991 Haertl ..... 381/325
5,166,659 A * 11/1992 Navarro ..... 181/130
5,327,500 A * 7/1994 Campbell ..... 381/322
6,000,492 A * 12/1999 Puthuff et al. ..... 181/135
6,105,713 A * 8/2000 Brimhall et al. ..... 181/135

* cited by examiner

*Primary Examiner*—Curtis Kuntz
*Assistant Examiner*—P. Dabney
(74) *Attorney, Agent, or Firm*—Michael Y. Epstein

(57) ABSTRACT

An otherwise conventional in-canal hearing aid, including a receiver providing a sound output port typically facing directly towards the ear drum of a user, is provided with a hood disposed between the sound port and the ear drum completely shielding the sound port from foreign substances moving towards the hearing aid from all directions except upwardly from the bottom floor of the user's ear canal. The hood can comprise solid vertical walls completely surrounding the sound port and forming a downwardly extending sound conduit terminating in a downwardly facing sound exit, or the vertical walls can comprise a mesh preferably also forming a downwardly facing sound conduit and sound exit. The hoods provide a gravity assisted path, particularly for mobile fluid components of the foreign substances, downwardly past and away from the receiver sound port. The hoods can be integral with the hearing aid envelope or provided in a kit of differently dimensioned hoods for being selectively attachable to existing hearing aids. The combination of avoiding entry of foreign substances into the sound conduit and the presence of fluid paths past the sound port greatly facilitates cleaning of the hearing aid, particularly by use of previously generally unavailable solvent washing.

14 Claims, 2 Drawing Sheets

PROTECTION AND SOLVENT WASHING OF IN-CANAL HEARING AIDS

The benefit of Provisional Application No. 60/210,640 filed Jun. 9, 2000 is claimed.

BACKGROUND OF THE INVENTION

This invention relates to hearing aids, and particularly to in-canal hearing aids including means for minimizing entry into the hearing aids of wax-fluid-like substances present within the ear canal and for solvent washing away such substances adhering to the hearing aids.

A major problem in the use of small hearing aids for full insertion within the ear canal of a user is the clogging of and even permanent damage to the hearing aid caused by penetration of foreign substances into the hearing aid. Primarily, although not limited thereto, such foreign substances are wax-like ear secretions and various fluids - both oil-like secretions and water entering the ear during washing and the like.

The prior art shows many examples of means for protecting hearing aids from such substances. One typical arrangement is shown in U.S. Pat. No. 4,984,277 to Bisgaard, et al. Therein is shown a typical in-canal hearing aid terminating in a sound port pointing, during use of the hearing aid, directly towards the user's ear drum. For preventing entry of foreign substances into the sound port, a small cap-like, impervious shield is mounted on the hearing aid directly in front of the sound port but spaced therefrom by mounting legs. Sound exiting from the sound port passes outwardly from the hearing aid through the spaces between the shield mounting legs and, while the sound is thus not directly aimed at the ear drum, the sound is guided by the walls of the ear canal to the ear drum.

As described in the patent, a primary function of the cap-like shield is to prevent foreign substances within the ear canal from being forced directly into the hearing aid during insertion of the hearing aid into the ear canal. In effect, the cap-like shield functions as a plow for pushing aside foreign substances in the path of advance of the hearing aid.

In a number of other patents, such as U.S. Pat. Nos. 3,408,461, 4,532,649, 4,706,778 and 4,972,488, apertured plates or screens are placed over the hearing aid sound port for trapping and collecting wax which would otherwise migrate directly into the sound port. A problem in all these patents (including the aforecited Bisgaard et al patent), is that the various openings through the plates or screens (or around the Bisgaard et al cap) are pervious to fluids within the ear canal which can pass through the openings directly into the heating aid. While collected wax is likely to merely clog the sound exit, fluids entering into the hearing aid receiver are likely to permanently damage the receiver. Also, because of the possibility of entry of fluids into the receiver, the use of wax-dissolving solvents for washing away accumulated wax is generally precluded. Thus, removal of accumulated wax can be quite difficult.

While many other patents show various schemes for collecting or trapping foreign substances as a means for protecting the hearing aids, experience has shown that such collection mechanisms are generally unsatisfactory and, indeed, many presently used hearing aids effectively ignore the problem and leave to the user the need for frequent cleaning or replacement of the hearing aid. The present invention greatly improves this situation.

SUMMARY OF THE INVENTION

An in-canal hearing aid includes a receiver having a sound port facing, when in use, directly towards the ear drum. Disposed directly in front of the sound port is a foreign substance shield which serves two functions: a) it provides a gravity assisted path for fluids downwardly past the sound port and directly to the floor of the ear canal below and preferably spaced from the sound port; and b) it provides surface areas along such fluid flow paths for accumulation of waxy solids which, upon removal of the hearing aid for cleaning, can be washed away with solvents likewise safely drained past the sound port.

In a first embodiment, the shield comprises an impervious hood spaced from the sound port and completely surrounding it except for a sound exit disposed downwardly of the sound port and facing directly towards the floor of the ear canal. Optionally, the downwardly facing sound exit is covered by a screen or mesh serving, primarily, for preventing direct insertion of foreign substances residing on hairs within the ear canal into the sound exit.

In a second embodiment, the shield comprises a sound pervious hood formed from a mesh which can be pervious to fluids but which is so spaced apart from entrances into the hearing aid that fluids reaching the mesh follow gravity assisted paths along surfaces of the mesh downward past and below the hearing aid entrances.

In both embodiments, while wax can possibly accumulate on surfaces of the hood, the downward slope of the hood serves as a gravity separator of the more mobile fluid components of the foreign substances for guided flow of the fluid components downwardly past and away from the hearing aid sound port.

The inventive hoods can comprise separate, preformed members, which can be fastened, e.g., by gluing, to existing hearing aids and which can be provided as a kit of differently dimensioned hoods.

Owing to the distance of the hood sound exit from the receiver sound port, solvent washing of wax from the vicinity of the hood exit is readily done with little danger of the solvent reaching and entering the receiver sound port.

DESCRIPTION OF THE DRAWINGS

The drawings are essentially schematic and not to scale.

DESCRIPTION OF PREFERRED EMBODIMENTS OF THE INVENTION

Figure 1:
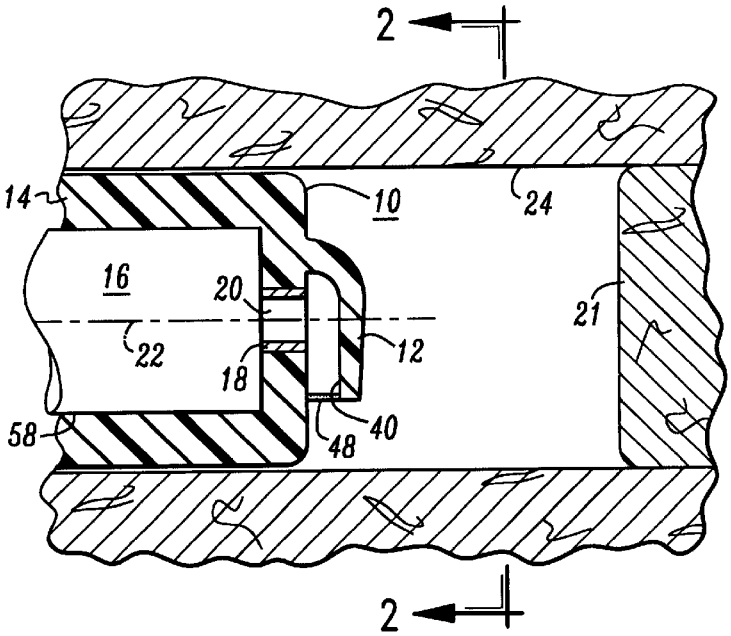
FIG. 1 is a side sectional view of the front end of a hearing aid according to the present invention disposed within the ear canal of a user of the hearing aid.
Figure 2:
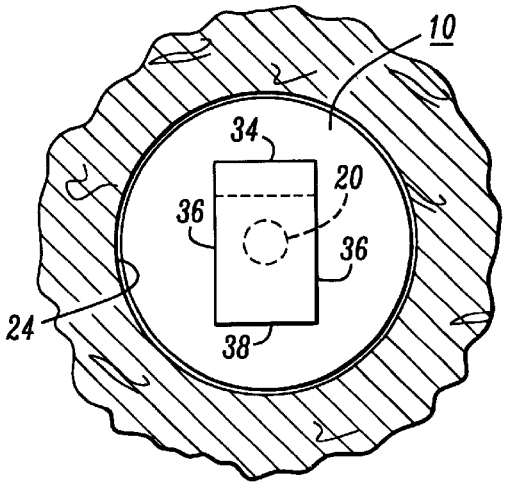
FIG. 2 is a view of the front end of the hearing aid shown in FIG. 1 looking in the direction of arrows 2—2 in FIG. 1.

Shown in FIGS. 1 and 2 is the front end of a hearing aid 10 disposed within the ear canal of a user. The hearing aid 10, except for the presence of a shield 12 in accordance with the present invention, can be of conventional design. Thus, the hearing aid 10 includes an envelope 14 enclosing a receiver 16 terminating in a sound tube 18 ending in a sound port 20 of the hearing aid. Typically, at least in those conventional hearing aids not including any foreign substance protection means, the sound port 20 comprises the leading end of the hearing aid and faces directly towards the ear drum 21 at the inner end of the user's ear canal. Also, and as shown in FIG. 1, the sound port 20 is disposed along the central axis 22 of the ear canal and at a small distance upwardly from the floor 24 of the ear canal.

In accordance with the present invention, a shield 12 is disposed directly in front of the sound port 20 but spaced therefrom to allow exiting of the sound from the hearing aid. In the embodiment illustrated in FIGS. 1 and 2, the shield 12 comprises a three-sided, impervious hood (similar in shape to an awning having side panels) completely overlapping the sound port 20 and extending from a line 34 directly above the sound port, along both sides 36 of the sound port, and to a line 38 below the sound port. At the bottom 38 of the hood shield 12 an exit 40 for sound is provided pointing directly downwardly towards the floor 24 of the ear canal. (FIG. 1 also shows a mesh 48 covering the hood exit 40. This is further discussed hereinafter.) The top 34 and side 36 edges of the hood 12 (also, see FIG. 3) are sealed to the hearing aid envelope 14. The sound exiting the sound port 20 passes downwardly through the hood 12 and towards the floor 24 of the ear canal and is thence directed to the ear drum.

The area of the path for sound through and outwardly of the hood 12 is selected, in accordance with known hearing aid design rules, not to degrade the quality of the sound being transmitted. While varying among different hearing aids, a typical sound port 20, at the end of a sound tube 18 mounted on a typical hearing aid receiver 16, has a cross-sectional area of around 0.00096 $in^2$ and a diameter of around 0.035 in. A suitable cross-sectional area for the sound through the hood 12 is also around 0.00096 $in^2$ but can, in accordance with known hearing aid design rules, be smaller. In general, the hood 12 can be as large as possible consistent with the space available (highly variable from user to user) within the user's ear canal. The path for sound downwardly through the hood can have a circular or rectilinear cross-section.

For proper, unimpeded flow of the sound outwardly (via the hood 12) of the hearing aid 10 to the user's ear drum, the hood exit 40 is preferably spaced at least slightly above the ear canal floor 24.

Conveniently, the hood 12 is an integral portion of the hearing aid envelope 14 and the hood is fabricated, typically by a known molding process, simultaneously with the formation of the envelope. In such case, the hood 12 can be of the same material but preferably of less wall thickness than the remainder of the hearing aid envelope for space conservation.

Figure 3:
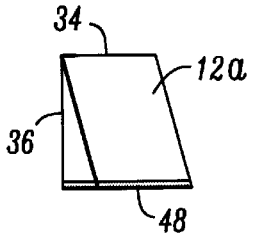
FIG. 3 is a perspective view of a hood manufactured as a separate part for attachment as by gluing, to the front end of hearing aids in accordance with the present invention.

Alternatively, a hood 12*a* can be fabricated, as shown in FIG. 3, as a separate three-sided part, and adhered to the front end of the hearing aid directly in front of the sound port 20. By running a small bead of a suitable glue, e.g., an acetone based glue for a typical hearing aid acrylic envelope 14, the hood 12*a* is readily and securely attached on the front end of the hearing aid in front of the forwardly facing sound port 20. Indeed, owing to the known difficulty of obtaining a comfortable fit of a custom-made hearing aid for an individual user, a preferred arrangement according to the invention is to provide a kit of differently shaped and sized hoods for selection for greatest comfort to the user. Selected and glued in place hoods, if found unsatisfactory, can readily be removed, as with a razor blade, and a substitute hood be tried for fit.

Also, during the life of the hearing aid, the hood can be readily removed and replaced by a hearing aid dispensing audiologist with only a slight disruption of the use of the hearing aid should the hood become excessively clogged with wax or the like. Also, the hood can be readily replaced with a hood of different shape and/or dimensions to accommodate changes in the condition of the user's ear canal due to, for example, temporary infections or the like. Being able to make such changes in the office of the audiologist, without having to return the hearing aid to the manufacturer, adds greatly to the utility of the hearing aid to the user.

The function of the inventive hoods (e.g., the illustrated hoods 12 and 12*a*) is as follows. During initial insertion of the hearing aid into the ear canal, the hoods serve as a plow for pushing aside any foreign material in the path of the advancing hearing aid. Quite commonly, globs of wax-like material lie along hairs projecting inwardly of the ear canal from the canal walls. In the absence of the plow-like function provided by the hoods, the very act of insertion of a hearing aid into the ear canal can cause direct insertion of such wax-like globs into the forward facing hearing aid sound port.

As previously noted, the use of cap-like shields (such as shown in the patent to Bisgaard, et al) disposed directly in front of the hearing aid sound port is known. However, such shields have a substantially continuous, circumferential opening between the cap-like shield and the front end of the hearing aid. Wax-like globs on hairs brushed aside by the leading cap-like shield press against the advancing hearing aid and can be forced, from all directions around the hearing aid, into the circumferencial opening. In the inventive hearing aids, however, the hoods open only downwardly and, in general, only wax-like fluids on upwardly directed hairs are likely to be thrust into the hood downwardly facing opening.

A principal advantage of the present invention is the reduction of flow of fluids within the ear canal into the hearing aid during actual use of the hearing aid. During such use, typically during waking hours of the user, the user's elongated ear canal is disposed in generally horizontal orientation, with a small downward slope from the ear drum towards the ear lobe. In such horizontal orientation, it is meaningful to refer to the "floor" of the ear canal with respect to up and down directions and, significantly, with respect to gravitational forces. During such waking hours, the hearing aid, typically of elongated shape, is likewise disposed horizontally (with top, bottom and front surfaces); with the hearing aid front surface facing directly towards the users' ear drum. Typically, the sound generating receiver within the hearing aid (see, e.g., FIG. 1) comprises a slightly elongated cylindrical can disposed horizontally within the hearing aid and terminating in a short, hollow sound tube extending horizontally forwardly from the receiver to the sound port of the hearing aid.

A long-standing problem with typical hearing aids is that wax and fluids are continuously entering the ear canal, mostly by internal secretions once the hearing aid is in place, and such secretions migrate into contact with the hearing aid and penetrate openings therein. Shields, such as the afore-described prior art cap-like shields disposed directly in front of the sound port, can limit entry of foreign substances into the sound port but do not provide adequate protection. Specifically, fluid-like secretions pass into the openings surrounding the cap-like shields, pass into the sound port and penetrate deeply therein. Removal is difficult and, if the fluids reach the receiver itself, permanent damage of the receiver can occur.

With the herein described hoods in place, fully blocking passage of fluids into the hoods from all directions other than directly upwardly from the floor of the ear canal, direct entry of fluids into the sound port of the receiver—or into the hearing aid itself—is greatly minimized. In effect, the protective hoods provide paths for harmless downward flow of fluids past the sound port to the canal floor.

During such downward flow, the fluids reach, before dripping off the hearing aid, the lip of the downwardly facing opening 40 at the bottom of the hood. Experience has shown that there is very little likelihood of such fluids migrating upwardly into the hood against the force of gravity. Also, there is little risk that the fluids dripping off the hearing aid will accumulate to such a height on the canal floor to enter into the hood sound exit. The dripping fluid is dispersed along a generally relatively large area of the canal floor which functions as a fluid collecting (and dispersing) sump for the hood directed fluid flow. Also, in normal usage, the hearing aid is removed by the user on a daily basis thus further avoiding significant fluid accumulation on the canal floor. Additionally, the exit 40 from the hood is preferably spaced as far as possible (dependent upon available space) below the sound port 20 from the receiver 16. Thus, even if foreign substances contact the bottom open end of the hood, the substances are still disposed beneath the receiver sound port 20 and, preferably, as far below the port 20 as space permits.

While not known for certain, it may be that the symmetrical sound port provided by cap-like shields, such as shown in the afore-cited patent to Bisgaard et al, are believed necessary for proper transmission of sound from the forwardly pointing sound port to the ear drum. However, with the hoods 12 and 12*a* illustrated herein, having a single downwardly facing sound exit (of an exit area as previously described), it is found that there is no measurable degradation of sound quality in comparison with otherwise identical hearing aids without such hoods.

For further protecting against forceful insertion of foreign substances into the hood exit opening 40, particularly during initial insertion of the hearing aid, the aforementioned sound pervious mesh 48 (FIG. 1) can be used overlapping the hood exit 40. While the mesh 48 is likely to increase the incidence of wax blockage of the hood exit by providing sites to which foreign substances can directly adhere, brushing such substances off the mesh is readily done with little danger of forcing the foreign substances inwardly of the hood during the brushing process. Indeed, another major advantage of the inventive hoods, particularly with an exit covering mesh, is that waxy substances adhering to the mesh can be quite easily washed away by a brush soaked in a solvent, e.g., denatured alcohol, without danger of the solvent reaching and entering the receiver sound port. (Preferably, the solvent is immediately removed by blotting or the application of a slight vacuum.)

Even without a bottom exit covering mesh, the herein described hoods function to prevent entry of waxy substances inwardly of the hoods and thus restrict the waxy substances to being accumulated on the external surfaces of the hoods and not within the sound conduits therethrough. Upon removal of the hearing aid for cleaning, the externally accumulated wax is readily accessible for removal by processes including the use of liquid solvents. By properly orienting the hearing aids during cleaning, e.g., in the same orientation as within the ear canal, the washing products drain along flow paths leading away from the sound ports. The ability to wash hearing aids with liquid solvents is a major advantage of the present invention.

The use of sound pervious meshes in hearing aids is known and described, for example, in certain of the afore-cited U.S. patents. Simply by way of example, and not limiting the choice of useable meshes, three examples of commercially available suitable meshes 48 each comprise a woven wire (e.g., stainless steel) of a) 80×80 strands per inch, 0.0055 in. diameter wire, and having a total open area of 31% (of the mesh area); b) 400×400 mesh, 0.0011 in. diameter wire, and 36% open area; and c) 200×200 mesh, 0.0016 in. diameter wire, and 46% open area.

As noted, a purpose of the inventive hoods is to provide a path for downward flow of fluids harmlessly past the sound port 20. Because of the relatively great downward pull provided by gravity, the flow will proceed even if a number of openings are provided through the vertical walls of the hood, for example, for the passage of sound. Even with small sound ports through the hood walls, a downward facing, relatively large sound exit opening 40 is still generally desirable for an alternate sound path if the vertical wall openings become clogged with wax-like substances and for providing drainage of mobile substances penetrating the hood wall openings for preventing accumulation of such substances within the hood.

Figure 4:
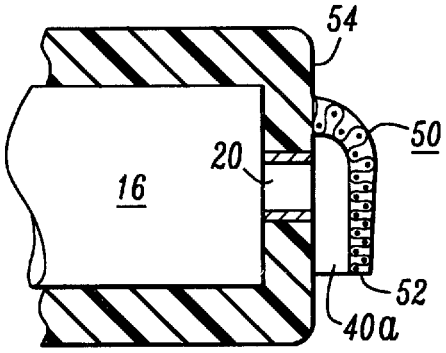
FIG. 4 shows a modification of the front end of the hearing aid shown in FIG. 1.
Figure 5:
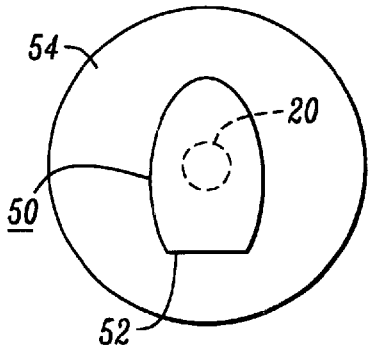
FIG. 5 is a front view of the hearing aid portion shown in FIG. 4.

Alternatively, as shown in FIGS. 4 and 5, the basically solid (even if apertured) hoods shown herein can be replaced by fully sound transparent hoods formed wholly from a mesh 50 having characteristics similar to those described for the mesh 48 shown in FIG. 1. Thus, even in the presence of the multiple openings through the mesh 50, fluids contacting the outside surface of the vertical mesh wall (even if penetrating the mesh wall and contacting the inner surface thereof) will flow downwardly along the mesh wall for by-passing the sound port 20.

Preferably, the bottom edge 52 of the mesh 50, except where secured to the hearing aid envelope, is spaced away from the envelope wall 54 to form a downwardly facing hood exit 40*a*. The spacing of the mesh bottom edge 52 from the envelope wall is important because, unlike the fluid impervious hood 12 shown in FIGS. 1 and 2, fluids can penetrate the hood mesh and, as noted, flow downwardly along the inside surface of the hood mesh. By avoiding a junction of most of the mesh lower edge with the envelope wall, contact of the downwardly flowing fluids with the envelope wall is essentially completely avoided. This avoids accumulation of fluids at the envelope walls and possible upward migration of the fluids into the sound port 20.

Such accumulation of fluids at the bottom edges of screens used in the prior art and attendant flow of the fluids into the hearing aid openings covered by the screens are a serious problem of the prior art use of screens.

For example, in U.S. Pat. No. 4,532,649 to Bellafiore, a mesh covers an opening through a hearing aid envelope spaced from the receiver sound tube end. A problem with this arrangement is that the mesh contacts the edges of the opening, hence fluids migrating along the mesh contact the opening edges and thence flow directly into the opening into the hearing aid. By spacing the bottom (as well as other edges of) the inventive mesh from the sound port, as shown in FIGS. 4 and 5 herein, the mesh contacting fluid flows completely past the sound port 20 and not into it.

It is further noted that a rather large variation exists in the size, shape and secretion characteristics of the ear canals of different persons. In situations where little fluid is normally present, and particularly in a relatively large ear canal, the bottom edge 52 of the mesh 50 is optionally secured to the hearing aid wall so that the mesh completely surrounds the sound port 20. An advantage of such complete peripheral sealing of the mesh to the hearing aid wall is greater mechanical strength. Still, as previously indicated, the entire peripheral edge of the mesh is preferably spaced (e.g., by a minimum of around 0.015 in.) from the edges of the sound port, for preventing entry of fluids into the sound port and, preferably, the bottom edge of the mesh is connected at the very bottom of the hearing aid front wall for minimizing upward flow of the fluids.

Such upward flow is further minimized if the mesh actually touches or is spaced closely above the canal floor, whereby fluids reaching the bottom of the mesh contact the canal floor for drainage away from the hearing aid.

Alternatively, the mesh bottom edge can include gaps in the edge contacting the hearing aid wall for better drainage of fluids downwardly from the mesh.

Figure 6:
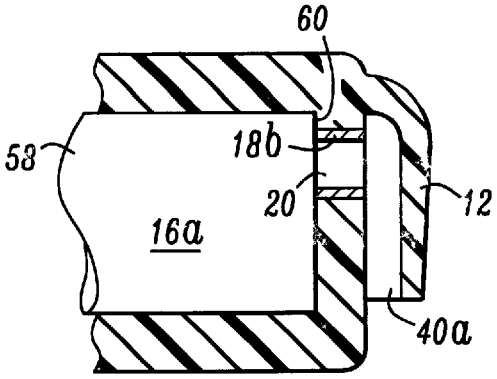
FIGS. 6 and 7 are views similar to FIG. 1 but showing two further modifications of the hearing aid shown in FIG. 1.

Typical receivers 16, such as shown in FIG. 1, comprise a slightly elongated can 58 terminating in an axially extending sound tube 18. Such axial alignment of the sound tube, in typical hearing aids, results in a central disposition of the hearing aid sound port facing directly towards the ear drum. A preferred arrangement of a hearing aid receiver 16*a*, however, in accordance with a fourth embodiment of the present invention, is as shown in FIG. 6. In the receiver 16*a*, the sound tube 18*b* is disposed at the upper end 60 of the receiver can 58 thus further distancing the receiver port from fluids possibly entering the hearing aid. The relatively small increase (e.g., around 0.040 in.) of the distance of the tube 18*b* from the hearing aid output exit 40*a* can be the difference between the requirement of a simple cleaning of the hearing aid versus discarding a permanently damaged hearing aid.

Figure 7:
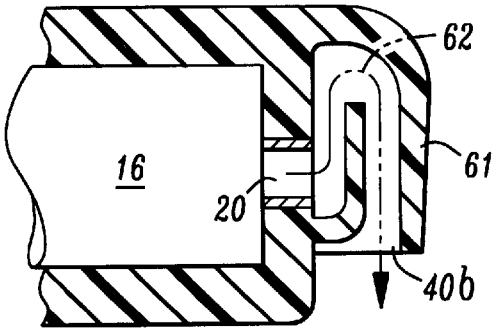

A further increase of the path length for foreign substances to the receiver port 20 is provided, as shown in FIG. 7, by the use of a hood 60 defining a sinuous or folded path 62 for sound through the hood. As in the other hoods, the sound exit 40*b* opens downwardly and at a position preferably below the sound port 20.

As mentioned, the inventive hoods can be added, as a separate part, to existing hearing aids. Owing to the simplicity of the invention, the hoods can easily be added, as by gluing, to previously manufactured hearing aids in the possession of users. Also, and in many instances, the inventive hoods can be readily incorporated into the design of presently manufactured hearing aids.

In addition to providing far greater protection of hearing aids from penetration of fluid-like foreign substances, major advantages of the inventive hoods are their simplicity and adaptability to differing ear canal conditions. As described, the inventive hoods can be easily added to existing types of hearing aids. Simplicity is provided by the basically different approach being used in comparison with priority known hearing aids. That is, based upon the generally symmetrical structures priorly used, it appears that the prior art has failed to recognize that the foreign substances to the protected against are an admixture of mobile fluids and generally immobile and adherent wax and, most significant, that the mobile fluids can separate from the immobile wax. Thus, a basic problem in many known hearing aids is that the foreign substance protection scheme involves collection of the foreign substances within traps or sumps actually within or closely adjacent to entrances into the hearing aid. The fact that the mobile fluids can thereafter separate from the collected substances appears to be ignored. Also ignored is the effect of gravity on the mobile fluids.

In comparison with the prior art, the present invention recognizes the admixture nature of the foreign substances and, to the extent that any accumulation of the foreign substances is likely to occur, the sites of such accumulation are preferably as far as possible, and most significantly, separated by an uphill path from any hearing aid entrances. Thus, to the extent that separation of the mobile fluid occurs, gravity is utilized for flowing the fluids away from the hearing aid entrances. Such gravity assisted guidance of mobile fluid components of the foreign substances away from the hearing aid entrances appears neither to be present nor to have been considered in the design of known hearing aids.

Stated slightly differently, the present invention differs from the prior art in that, rather than attempting to capture or trap the foreign substances, thus requiring complex and space consuming foreign substance collecting areas, the inventive hoods simply by-pass the foreign substances at a safe distance from the sound port and require only minimal increases in hearing aid dimensions. Additionally, to the extent that wax-fluid substances do accumulate on the hoods and within various openings therethrough, cleaning of the hoods is greatly facilitated by the uphill separation of the receiver sound port from the hood opening. Thus, vigorous brushing and, in particular, previously impractical solvent washing techniques, can be used with little danger of forcing the wax-fluids or the cleaning solvent directly into the receiver for causing permanent damage.

Additionally, as previously described, waxy solids which accumulate along the flow paths can be readily solvent washed and brushed away. Most significantly, such accumulated solids are not within the hearing aid sound conduit, but on external surfaces of the hearing aid where they are readily accessible for washing and safe draining. In many known hearing aids, waxy substances penetrate the sound conduits where they are essentially inaccessible for simple cleaning processes.

What is claimed is:

1. A hearing aid for use within an elongated ear canal of a user's ear, said canal being, during typical use of the hearing aid, generally horizontally oriented and being underlaid by a canal floor extending to the user's ear drum, said hearing aid including a receiver having a first sound port disposed at a first height above said canal floor, and a fluid barrier disposed between said first port and said ear drum for blocking flow of fluids within said canal into said first port from all directions other than upwardly from said canal floor.

2. A hearing aid according to claim 1 wherein said first sound port faces directly towards said ear drum, and said fluid barrier comprises a fluid diverting hood disposed between said sound port and said ear drum and extending from a position above said port, downwardly along both sides of said port, and to a position below said port and above said canal floor.

3. A hearing aid according to claim 2 wherein said hood is impervious to fluids and forms, below said first sound port, a second sound port facing directly downwardly.

4. A hearing aid according to claim 3 including a sound pervious mesh covering said downwardly facing second port.

5. A hearing aid according to claim 2 wherein said hearing aid includes an envelope having an opening therethrough defining said first sound port, said fluid barrier having top and side edges forming a continuous joint with said envelope, and said joint being spaced from and surrounding said opening on all sides thereof except directly below said opening.

6. A hearing aid according to claim 5 wherein said hood is impervious to fluids and forms, below said first sound port, a second sound port facing directly downwardly.

7. A hearing aid according to claim 5 wherein said hood comprises a mesh pervious to fluids but providing a path for fluids contacting said mesh downwardly past and spaced from said first sound port opening.

8. A hearing aid according to claim 1 wherein said receiver has a central, horizontal axis, and said first sound port is disposed above said axis.

9. A hearing aid according to claim 1 wherein said fluid barrier defines a path for sound from said first sound port to a second sound port from which sound from said receiver exits said hearing aid for passage to said ear drum, said sound path being folded back on itself.

10. A hearing aid according to claim 9 wherein said path extends along a first portion thereof upwardly from said first sound port to a position above said first sound port and then downwardly along a second portion of said path spaced from said first portion past said first sound port to said second sound port.

11. A hearing aid according to claim 10 wherein said second sound port is disposed below said first sound port and opens directly downwardly.

12. A kit of parts for use with hearing aids each including a receiver terminating in a sound tube extending to a sound port positioned at an end of an envelope of the hearing aid, said sound port and envelope end, during use of said each hearing aid in the ear canal of a respective user, facing towards the ear drum within said canal, said kit comprising a plurality of differently dimensioned hoods each including a surface for attachment to said envelope end and being shaped, when attached in enclosing relation with said sound port, for providing a sound conduit for all sound from said sound port, said sound conduit terminating in a sound exit facing solely downwardly towards the floor of the user's canal.

13. A hearing aid for use within an elongated ear canal of a user's ear, said canal being, during typical use of the hearing aid, generally horizontally oriented and being underlaid by a canal floor extending to the user's ear drum, said hearing aid including a receiver having a first sound port disposed at a first height above said canal floor, and a fluid barrier disposed between said first port and said ear drum for blocking flow of fluids within said canal into said first port from all direction other than upwardly from said canal floor, said first sound port facing directly towards said ear drum, said fluid barrier comprising a fluid diverting hood disposed between said sound port and said ear drum and extending from a position above said port, downwardly along both sides of said port, and to a position below said port and above said canal floor, and said hood comprising a sound pervious mesh.

14. A hearing aid according to claim 13 wherein said hearing aid includes an enclosing wall having a first portion facing said ear drum, said first port comprising an opening through said wall first portion, and said mesh has a peripheral edge attached to said wall first portion along a line completely encircling said first port.

* * * * *